US006018323A

United States Patent [19]

Van Hoozen et al.

[11] Patent Number: 6,018,323

[45] Date of Patent: Jan. 25, 2000

[54] BIDIRECTIONAL BROADBAND LOG-PERIODIC ANTENNA ASSEMBLY

[75] Inventors: Allen Lee Van Hoozen, Schaumburg; John J. Ball, McHenry, both of Ill.

[73] Assignee: Northrop Grumman Corporation, Los Angeles, Calif.

[21] Appl. No.: 09/056,978

[22] Filed: Apr. 8, 1998

[51] Int. Cl.[7] ..... H01Q 1/36

[52] U.S. Cl. ..... 343/792.5; 343/895; 343/700 MS

[58] Field of Search ..... 343/792.5, 895, 343/700 MS, 739, 756, 789, 859

[56] References Cited

U.S. PATENT DOCUMENTS

| | | | |
|---|---|---|---|
| Re. 29,911 | 2/1979 | Munson | 343/700 |
| 2,985,879 | 7/1961 | Du Hamel | 343/908 |
| 3,534,372 | 10/1970 | Scheuerecker et al. | 343/742 |
| 3,683,390 | 8/1972 | Cory et al. | 343/792.5 |
| 3,696,437 | 10/1972 | Grant | 343/792.5 |
| 3,990,079 | 11/1976 | Epis | 343/771 |
| 4,063,249 | 12/1977 | Bergander et al. | 343/756 |
| 4,117,489 | 9/1978 | Kaloi | 343/700 |
| 4,163,236 | 7/1979 | Kaloi | 343/700 |
| 4,170,012 | 10/1979 | Kaloi | 343/700 |
| 4,243,993 | 1/1981 | Lamberty et al. | 343/895 |
| 4,326,203 | 4/1982 | Kaloi | 343/700 |
| 4,364,050 | 12/1982 | Lopez | 343/700 |
| 4,401,988 | 8/1983 | Kaloi | 343/700 |
| 4,445,122 | 4/1984 | Pues | 343/700 |
| 4,450,449 | 5/1984 | Jewitt | 343/700 |
| 4,594,595 | 6/1986 | Struckman | 343/770 |
| 4,608,572 | 8/1986 | Blakney et al. | 343/792 |
| 4,761,654 | 8/1988 | Zaghloul | 343/700 |
| 4,835,538 | 5/1989 | McKenna et al. | 343/700 MS |
| 4,849,765 | 7/1989 | Marko | 343/702 |
| 4,864,314 | 9/1989 | Bond | 343/700 |
| 4,907,011 | 3/1990 | Kuo | 343/792.5 |
| 4,943,809 | 7/1990 | Zaghloul | 343/700 |
| 5,005,019 | 4/1991 | Zaghloul et al. | 343/700 |
| 5,008,681 | 4/1991 | Cavallaro et al. | 343/700 |
| 5,021,796 | 6/1991 | Corzine et al. | 343/712 |
| 5,111,211 | 5/1992 | Dahlberg | 343/700 |
| 5,124,713 | 6/1992 | Mayes et al. | 343/700 |
| 5,164,738 | 11/1992 | Walter et al. | 343/789 |
| 5,170,175 | 12/1992 | Kobus et al. | 343/895 |
| 5,187,490 | 2/1993 | Ohta et al. | 343/700 |
| 5,191,351 | 3/1993 | Hofer et al. | 343/895 |
| 5,210,541 | 5/1993 | Hall et al. | 343/700 |
| 5,212,494 | 5/1993 | Hofer et al. | 343/859 |
| 5,220,335 | 6/1993 | Huang | 343/700 |
| 5,231,406 | 7/1993 | Sreenivas | 343/700 |
| 5,309,163 | 5/1994 | Ngan et al. | 343/700 |
| 5,313,216 | 5/1994 | Wang et al. | 343/700 |

(List continued on next page.)

*Primary Examiner*—Don Wong
*Assistant Examiner*—James Clinger
*Attorney, Agent, or Firm*—Terry J. Anderson; Karl J. Hoch, Jr.

[57] ABSTRACT

A bidirectional broadband log-periodic antenna assembly has a printed wiring board having a plurality of log-periodic antennas etched upon at least one side thereof. Each log-periodic antenna comprises a plurality of antenna elements extending from a common trunk. A resistive film is formed upon a distal end of a longest antenna element extending from at least one trunk. The resistive film enhances a low frequency response of the antenna.

25 Claims, 3 Drawing Sheets

U.S. PATENT DOCUMENTS

| | | | |
|---|---|---|---|
| 5,315,753 | 5/1994 | Jensen et al. | 29/600 |
| 5,376,942 | 12/1994 | Shiga | 343/700 |
| 5,382,959 | 1/1995 | Pett et al. | 343/700 |
| 5,400,040 | 3/1995 | Lane et al. | 343/700 |
| 5,400,041 | 3/1995 | Strickland | 343/700 |
| 5,410,323 | 4/1995 | Kuroda | 343/700 |
| 5,448,250 | 9/1995 | Day | 343/700 |
| 5,448,252 | 9/1995 | Ali et al. | 343/700 MS |
| 5,453,751 | 9/1995 | Tsukamoto et al. | 343/700 |
| 5,471,220 | 11/1995 | Hammers et al. | 342/372 |
| 5,471,664 | 11/1995 | Kim | 455/323 |
| 5,477,231 | 12/1995 | Medard | 343/700 |
| 5,483,678 | 1/1996 | Abe | 455/80 |
| 5,497,164 | 3/1996 | Croq | 343/700 |
| 5,506,592 | 4/1996 | MacDonald et al. | 343/846 |
| 5,510,803 | 4/1996 | Ishizaka et al. | 343/700 |
| 5,565,875 | 10/1996 | Buralli et al. | 343/700 |
| 5,572,222 | 11/1996 | Mailandt et al. | 343/700 |
| 5,576,718 | 11/1996 | Buralli et al. | 343/700 |
| 5,594,455 | 1/1997 | Hori et al. | 343/700 |
| 5,657,028 | 8/1997 | Sanad | 343/700 |
| 5,680,144 | 10/1997 | Sanad | 343/700 |
| 5,703,601 | 12/1997 | Nalbandian et al. | 343/700 |
| 5,712,647 | 1/1998 | Shively | 343/895 |

Fig. 3
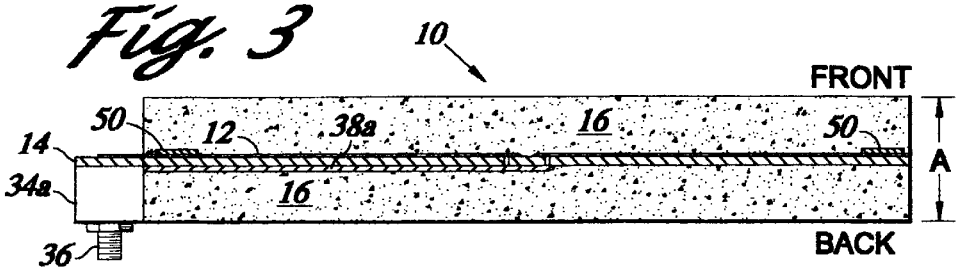
Fig. 4
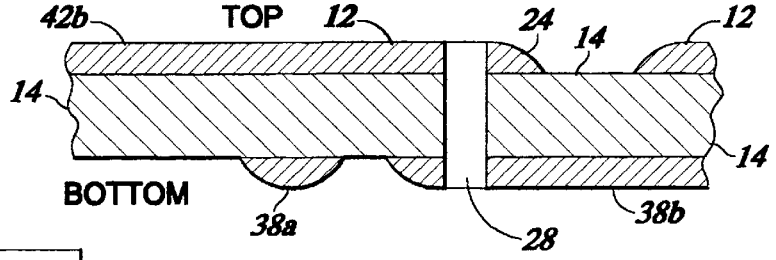
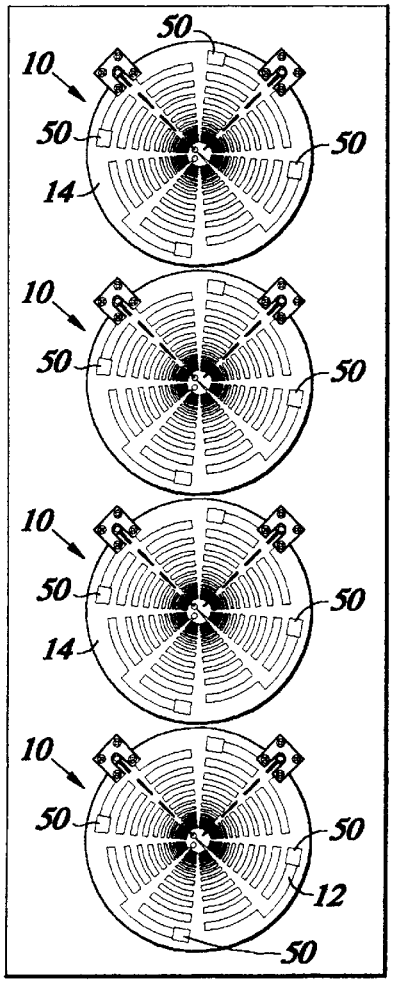
Fig. 5a
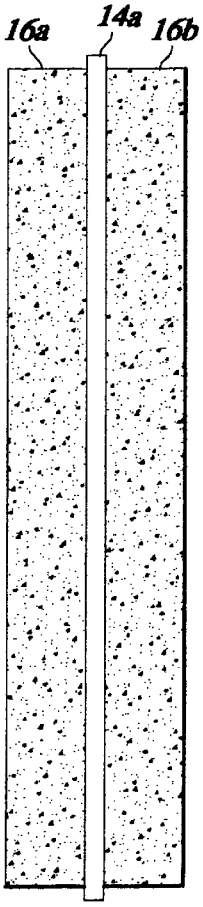
Fig. 5b

BIDIRECTIONAL BROADBAND LOG-PERIODIC ANTENNA ASSEMBLY

FIELD OF THE INVENTION

The present invention relates generally to broadband antennas and more particularly to a broadband log-periodic antenna assembly having enhanced low frequency response.

BACKGROUND OF THE INVENTION

Broadband antennas for receiving a broadband of radio-frequency signals are well known. Such broadband antennas generally comprise a plurality of antenna elements of different lengths electrically connected to one another such that at least one of the antenna elements is suitable for receiving and/or transmitting at a desired frequency.

It is also known to form such an array of antenna elements in a flat, generally circular configuration so as to define a broadband antenna which requires minimal volume. One example of such a circular broadband antenna is disclosed in U.S. Pat. No. 4,594,595 issued on Jun. 10, 1986 to Struckman and entitled CIRCULAR LOG-PERIODIC DIRECTION-FINDER ARRAY.

Log periodic antennas are also well known. In a log periodic antenna the elements of the antenna increase in length at a logarithmic rate and alternate such that every other element is on an opposite side of a common conductor or trunk. The benefit of such a log periodic configuration is that a substantially greater band width is achieved.

Examples of such circular log periodic antennas are provided in U.S. Pat. No. 4,063,249, issued on Dec. 13, 1997 to Bergander et al., and entitled SMALL BROADBAND ANTENNA HAVING POLARIZATION SENSITIVE REFLECTOR SYSTEM; U.S. Pat. No. 5,164,738, issued on Nov. 17, 1992 to Walter et al., and entitled WIDE BAND DUAL-POLARIZED MULTIMODE ANTENNA; and U.S. Pat. No. 5,212,494 issued on May 18, 1993 to Hoffer et al., and entitled COMPACT MULTI-POLARIZED BROADBAND ANTENNA.

It is worthy to note that various different linear polarizations, as well as the ability to receive and transmit circularly polarized signals, are achieved in Hoffer et al., and Walter et al., by forming the circular antenna assembly to comprise two orthogonal log-periodic antennas. By way of contrast, Bergander utilizes two separate orthogonal antenna assemblies to achieve the same result.

Although log-periodic antennas have proven generally suitable for their intended uses, such conventional antennas are generally too physically large to be utilized in applications wherein it is desirable that the antenna be as small as possible. Size is particularly important in small aircraft, spacecraft, and missiles. For example, the Unmanned Air Vehicle (UAV) is an unmanned military surveillance aircraft which must fly a considerable distance without refueling. Thus, it is desirable to minimize the weight of the aircraft, so as to increase the effective range thereof. Such weight constraints limit the physical size of any antenna to be utilized. The small size of the UAV also dictates the use of a small antenna.

Thus, as those skilled in the art will appreciate, it is desirable to provide a broadband log-periodic antenna assembly which is comparatively small in size and therefore does not contribute substantially to the weight of a vehicle to which it is attached and is also suitable for use in very small vehicles.

SUMMARY OF THE INVENTION

The present invention specifically addresses and alleviates the above mentioned deficiencies associated with the prior art. More particularly, the present invention comprises a bidirectional broadband log-periodic antenna assembly having an enhanced low frequency response. The antenna assembly comprises a printed wiring board having front and back sides and a plurality of individual log-periodic antennas etched upon at least one side of the printed wiring board.

Each log-periodic antenna comprises a plurality of separate antenna elements extending from a common trunk. The trunk of each log-periodic antenna extends generally radially from a common point.

A foam spacer having front and back sides is preferably disposed at the front and back surfaces of the printed wiring board.

Each antenna element preferably comprises portions of generally concentric circles. Thus, the antenna assembly comprises a plurality of segments of generally concentric circles.

According to the preferred embodiment of the present invention, each antenna comprises two diametrically opposed trunks, each trunk having elements of substantially identical lengths extending generally perpendicularly therefrom in generally opposite directions.

The plurality of log-periodic antennas preferably comprise two log-periodic antennas disposed generally radially orthogonal to one another, so as to facilitate the reception and transmission of a plurality of polarizations of plane polarized electromagnetic radiation as well as circularly polarized electromagnetic radiation. Those skilled in the art will appreciate that plane polarized and circularly polarized (either right or left hand) electromagnetic radiation can be received or transmitted via two antennas which are oriented perpendicular with respect to one another.

According to the preferred embodiment of the present invention, the plurality of log-periodic antennas comprise two log-periodic antennas disposed generally radially orthogonal to one another, each of the two antennas comprising two diametrically opposed trunks.

A resistive film is formed at a distal end of at least one, preferably both, of the elements of at least one, preferably both, of the antennas such that the resistive film is in electrical contract with the element(s), so as to enhance the low frequency response of those elements. As those skilled in the art will appreciate, the application of such a resistive film increases the apparent length of the element, and thus enhances the response of the element to lower frequencies. In this manner, a substantially more compact and volume efficient broadband antenna is formed.

Thus, a resistive film is formed upon a distal end of at least one of the longest antenna elements which extend from at least one of the trunks of the antenna. The resistive film preferably comprises a material having a resistivity of between approximately 125 and 150 ohms per square. The resistive film preferably comprises carbon. However, those skilled in the art will appreciate that various other materials, having a resistivity in the desired range, are likewise suitable.

According to the preferred embodiment of the present invention, an adhesive attaches the resistive film to the antenna elements. The adhesive preferably comprises either double-sided adhesive tape or an adhesive film. Those skilled in the art will appreciate that an adhesive film is a thin film of adhesive material which tends to liquify and bond materials together when heated and subsequently cooled back to ambient temperature.

Optionally, a foam layer covers the resistive film so as to provide wear and environmental protection therefore.

The resistive film preferably has a width approximately equal to the width of antenna element upon which it is formed. Optionally, the resistive film may extend slightly beyond the width of the antenna element.

The resistive film preferably has a length approximately equal to two times the width of the antenna element upon which it is formed. Similarly, the resistive film may extend slightly beyond the end of the antenna element upon which it is formed.

According to the preferred embodiment of the present invention, the antennas are etched upon the front side of the printed wiring board. However, as those skilled in the art will appreciate, the antennas may be formed on the front side, rear side, and/or upon an intermediate layer of the printed wiring board, as desired.

Further, according to the present invention, the antenna elements of adjacent antennas are not interleaved. However, according to an alternative embodiment of the present invention, the antenna elements may be interleaved, so as to further broaden the frequency response of the antenna.

The foam spacer is sufficiently flexible so as to allow the antenna assembly to substantially conform to a curved non-metallic radome. That is, the flexible foam spacer is sufficiently resilient to accommodate a curved dielectric backing, such as a panel of a aircraft. Further, the printed wiring board is preferably sufficiently thin so as to allow the antenna assembly to substantially conform to such a curved dielectric backing. As such, the printed wiring board is also sufficiently flexible so as to allow the antenna assembly to substantially conform to a curved dielectric backing. Thus, the printed wiring board and foam spacer are all preferably configured so as to substantially conform to a curved dielectric backing.

The dielectric backing may be defined by a preexisting structure, or may alternatively be formed as an integral part of the antenna assembly of the present invention. More particularly, the dielectric backing may be defined by a portion of an aircraft, such as an unmanned air vehicle, for which the present invention is particularly well suited.

The dielectric layer preferably comprises a low loss foam such as Rohacell 110 wf, manufactured by ROHM GMBH CHEMISCHE FABRIK of Darmastadt, Germany.

In any instance, the dielectric backing preferably supports the printed wiring board, as well as other components of the bidirectional log-periodic antenna of the present invention.

The bidirectional log-periodic antenna assembly of the present invention may be formed into an array for use in various different particular applications. For example, a linear array may be formed along the side of an aircraft, so as to enhance antenna gain according to well known principles.

Because of its small size, wide bandwidth, and ability to conform to the curved shape of a preexisting structure, the bidirectional log-periodic antenna assembly of the present invention finds particular applications in unmanned air vehicles. As those skilled in the art will appreciate, a broadband antenna is required so as to facilitate the reception and transmission of different types of radio signals, each having widely diverse frequencies. This facilitates the transmission and reception of signals for such purposes as flight control, and the communication of surveillance data, which may require widely diverse frequencies. The use of such a broadband antenna also facilitates the use of spread spectrum technology so as to inhibit undesirable reception of the signal and also so as to inhibit undesirable jamming thereof. A plurality of such bidirectional broadband log-periodic antenna assemblies may be formed into a generally linear configuration so as to generally surround a substantial portion of the aircraft body, thereby facilitating the reception and transmission of radio signals in both directions orthogonal to the PWB.

Thus, the present invention provides a broad band log-periodic antenna assembly which is comparatively thin and therefore does not extend substantially above the surface upon which it is mounted and which may be formed so as to generally conform to that surface so as to facilitate conformal mounting upon curved surfaces.

BRIEF DESCRIPTION OF THE DRAWINGS

FIG. 3 is a side view showing the bidirectional broadband log-periodic antenna of FIG. 1;

FIG. 4 is an enlarged side view, partially in section, showing the vias and bridge used to interconnect two of the diagonally opposed trunks of one of the two log-periodic antennas of the assembly of FIG. 1;

FIG. 5*a* is a front view of a linear array of four bidirectional broadband log-periodic antenna assemblies of the present invention having one foam layer removed to show the resistive films thereof;

FIG. 5*b* is a side view of the linear array of FIG. 5*a,* showing both layers of foam, one on each side of the printed wiring board.

DETAILED DESCRIPTION OF THE PREFERRED INVENTION

The detailed description set forth below in connection with the appended drawings is intended as description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The bidirectional broadband log-periodic assembly of the present invention is illustrated in FIGS. 1–6 which depict presently preferred embodiments thereof.

Figure 1:
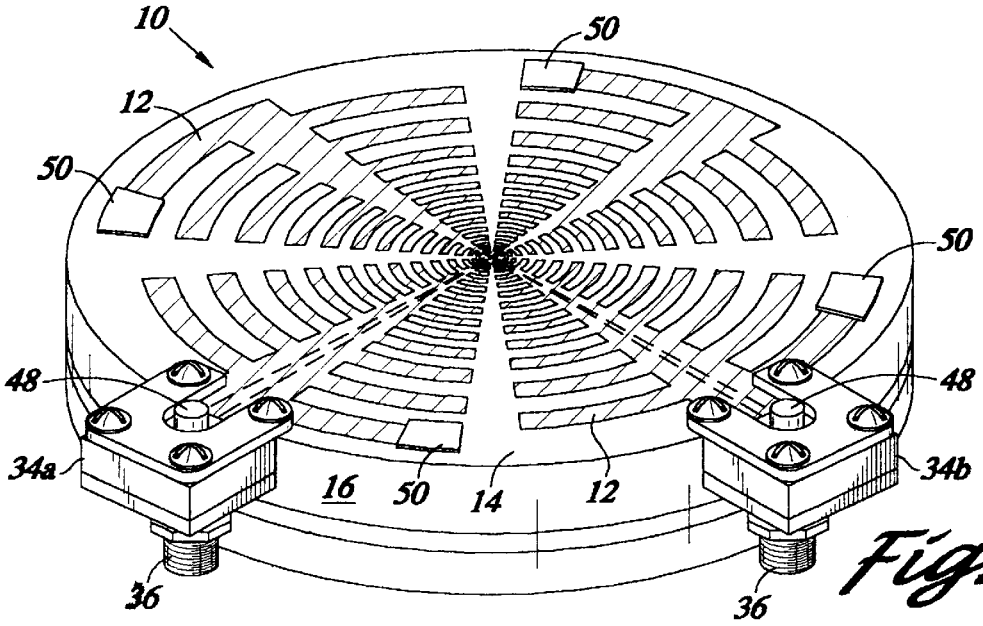
FIG. 1 is a perspective view of the bidirectional broadband log-periodic antenna assembly of the present invention showing two log-periodic antennas etched upon the front side of the printed wiring board and also having one foam layer removed to show the resistive film formed on the distal end of the longest elements thereof.
Figure 2:
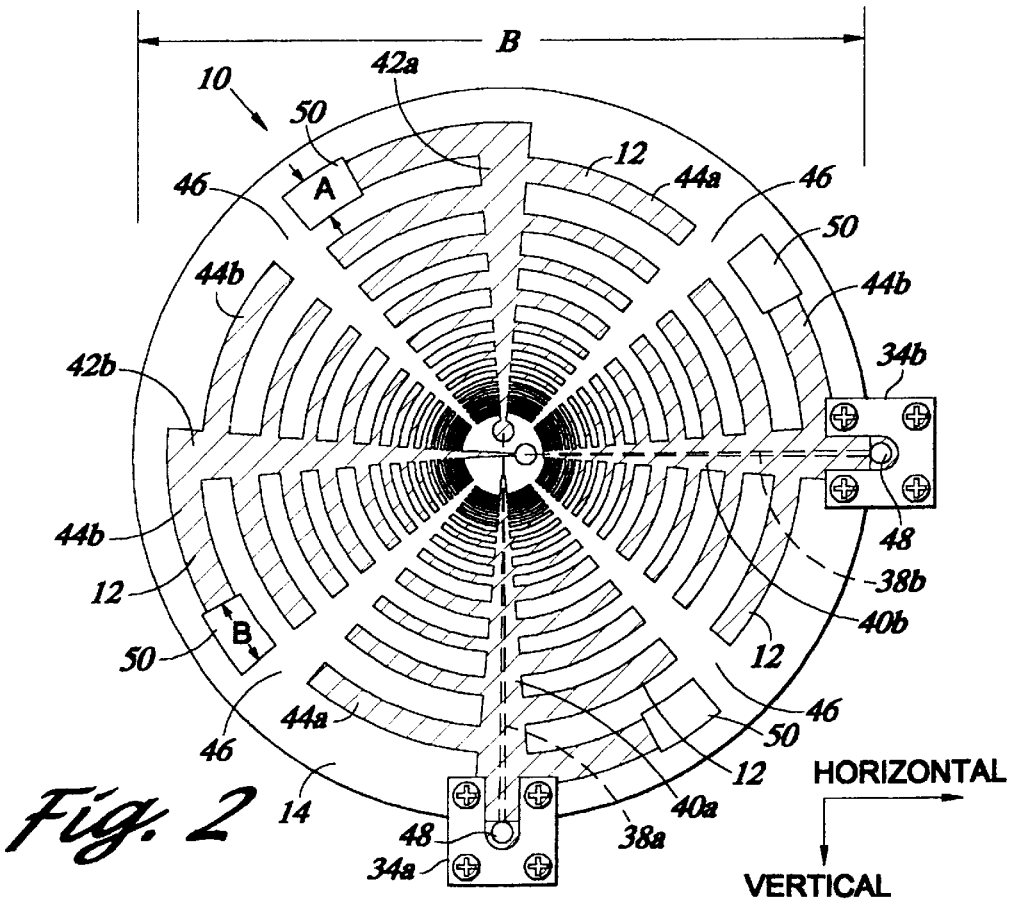
FIG. 2 is a front view of the bidirectional broadband log-periodic antenna assembly of FIG. 1, having one foam layer removed to show the two log-periodic antennas etched upon the printed wiring board.

Referring now to FIGS. 1–3, the present invention generally comprises a plurality of etched antennas 12 formed upon an insulating substrate, i.e., printed on the front of a printed wiring board (PWB) 14. The back of the printed wiring board is attached to a foam spacer 16.

A resistive film 50 is formed upon the distal end of at least one, preferably all, of the longest antenna elements, i.e., those at the outer periphery of the antenna. As discussed above, such a resistive film substantially enhances the low frequency response of the antenna. The resistive film 50 preferably comprises a material having a resistivity of between approximately 125 and approximately 150 ohms per square. The resistive film preferably comprises carbon. However, those skilled in the art will appreciate that various other materials are likewise suitable.

According to the preferred embodiment of the present invention, an adhesive attaches the resistive film to the antenna element. The adhesive preferably comprises either double-sided adhesive tape or adhesive film.

Optionally, a dielectric layer substantially covers the resistive film. The resistive film preferably has a width dimension A approximately equal to the width of the antenna element upon which it is formed. The resistive film preferably has a length, dimension B, approximately equal to twice the width of the antenna element upon which it is formed. The thickness of the resistive film is not critical. A thickness of 1 to 50 microns is suitable.

With particular reference to FIG. 2, the etched antennas 12 preferably comprise a pair of etched antennas defined by first and second trunks 40*a* and 42*a* which are orthogonal to third and fourth trunks 40*b* and 42*b*. The first and second trunks 40*a* and 42*a*, taken along with the antenna elements 44*a* extending generally perpendicularly therefrom define the first log-periodic antenna and the third and fourth trunks 40*b* and 42*b*, taken along with elements 44*b* extending therefrom define the second log-periodic antenna.

The first trunk 40*a* is electrically connected to first connector block 34*a*, preferably such that it is in electrical communication with the shielded conductor of coaxial connector 36, while the micro strip conductor 38*a* is preferably connected so as to be in electrical communication with the center conductor 48 of the conductor block 34*a*.

Similarly, the second trunk 40*b* is electrically connected to the second connector block 34*b*, preferably such that it is in electrical communication with the shielded conductor of the co-axial connector 36, while the microstrip conductor 38*b* is connected so as to be in electrical communication with the center conductor 48 of the conductor block 34*b*.

The micro strip conductor 38*a* attaches to the trunk 42*a* near the center of the antenna, as discussed in detail below. Similarly, the micro strip conductor 38*b* places the center conductor 48 of the second connector block 34 in electrical communication with the trunk 42*b* of the second log-periodic antenna via interconnection thereto at the center of the antenna assembly.

Each trunk 40*a*, 40*b*, 42*a*, and 42*b* has a plurality of antenna elements 44 extending generally perpendicularly therefrom so as to define a plurality of generally concentric circle segments which, according to the preferred embodiment of the present invention, do not interleave with one another. Thus, axial spaces 46 are defined between adjacent perpendicular antennas.

It is important to note that one antenna is defined by the two vertical trunks 40*a* and 42*a*, along with the antenna elements 44*a* extending therefrom; while a second, electrically isolated and independent antenna, is defined by the two horizontal trunks 40*b* and 42*b* along with the antenna elements 44*b* extending therefrom. Thus, the bidirectional log-periodic antenna assembly of the present invention may be utilized to either transmit or receive linearly polarized radio frequency signals at any desired angle, e.g., 15 degrees, 45 degrees, 60 degrees, etc., and may also be utilized to either transmit or received either right or left handed circularly polarized radio frequency signals.

Elements 44*a*, 44*b* of the two separate log-periodic antennas increase in length as the periphery of the antenna assembly is approached according to a log-periodic configuration.

With particular reference to FIG. 3, the bidirectional log-periodic antenna assembly of the present invention is preferably configured such that the thickness thereof dimension A is approximately 0.5 inch.

According to the preferred embodiment of the present invention, the diameter of the bidirectional log-periodic antenna assembly, dimension B of FIG. 2, is approximately 3 inches. The dielectric is preferably approximately 0.01 inch thick. Each foam spacer is approximately 0.25 inch thick.

Referring now to FIG. 4, the electrical connection of one of the trunks, such as 42*b*, to the associated micro strip conductor 38*b*, is shown. As those skilled in the art will appreciate, one of the trunks, such as 42*a* may be connected to its associated micro strip conductor 38*a* via the etching of a conductive trace. However, a second conductive trace can not be utilized without either the formation of a via or an insulating layer, so as to prevent undesirable shorting of the first antenna to the second antennas. Thus, according to the preferred embodiment of the present invention, vias 28 and 30 facilitate the formation of conductive conduits from one of the micro strip conductors, such as 38*b* to its associated trunk, such as 42*b*. A conductive bridge 32, formed upon the underside of the printed wiring board 14 interconnects the conductive conduits formed within the vias 28 and 30.

Alternatively, the first micro strip conductor 32*a* is connected to the first trunk 42*a* at the center of the first log-periodic antenna and then an insulating layer is formed thereover. This facilitates the interconnection of the second micro strip conductor 38 with the second trunk 42 in a similar fashion, i.e., via an etched conductor at the center of the second log-periodic antenna.

An insulating layer separates the first micro strip conductor 32*a* from the first trunk 40*a* and similarly separates the second micro strip conductor 38*b* from the second trunk 40*b*.

Thus, as described above, the first log-periodic antenna comprises a first trunk 402 connected to the feed conductors at the outer periphery of the antenna while the second trunk 42*a* thereof is connected to the feed near the center. The second log-periodic antenna is connected to its feed lines in a similar manner. Such interconnection of the first and second log-periodic antennas maintains the desired polarity of induced signals in the antenna elements 44*a* and 44*b*, as described in detail below.

Referring now to FIGS. 5*a* and 5*b* a linear array comprised of four separate log-periodic antenna assemblies of the present invention as shown. Such an array may be utilized so as to increase the gain of the antenna system, thereby facilitating the detection of the weaker radio signals.

With particular reference to FIG. 5*b*, the foam is applied to both sides of the printed circuit board 14*a*. In the array of log periodic antenna assemblies, the printed wiring board 14*a* preferably extends among all of the antenna assemblies, thereby defining a common printed wiring board. Likewise, the foam 16*a* and 16*b*, formed on either side of the printed wiring board 14*a* similarly extends so as to cover all of the log-periodic antenna assemblies. However, as those skilled in the art will appreciate, separate printed wiring boards and separate foam coverings are likewise suitable.

Figure 6A:
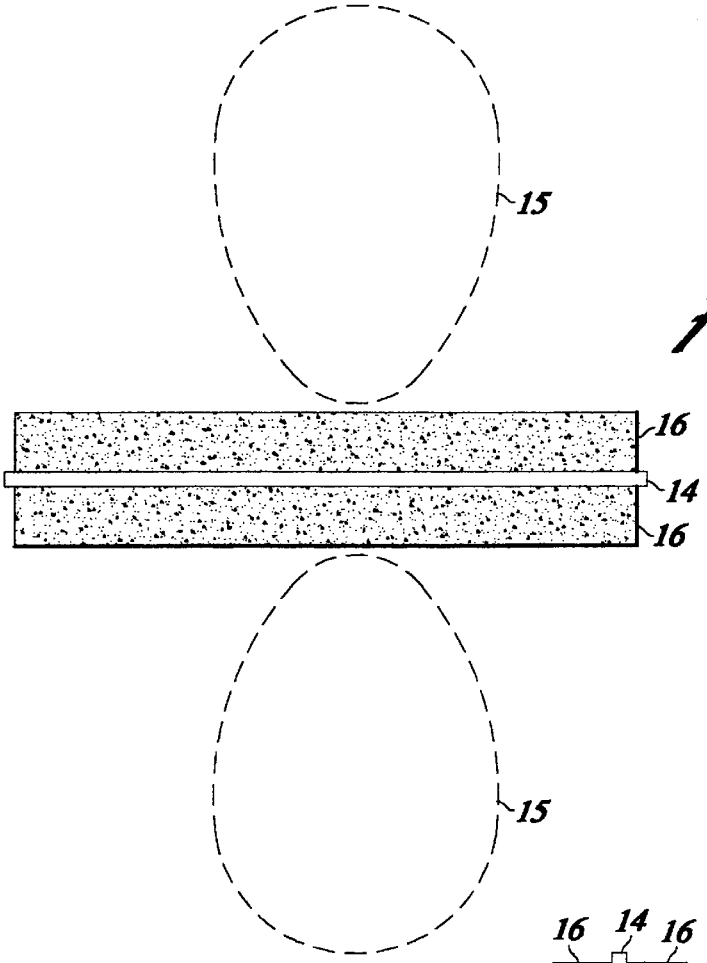
FIGS. 6*a* and 6*b* end views of the bidirectional broadband log-periodic antenna assembly of the present invention, showing the beam patterns thereof.
Figure 6B:
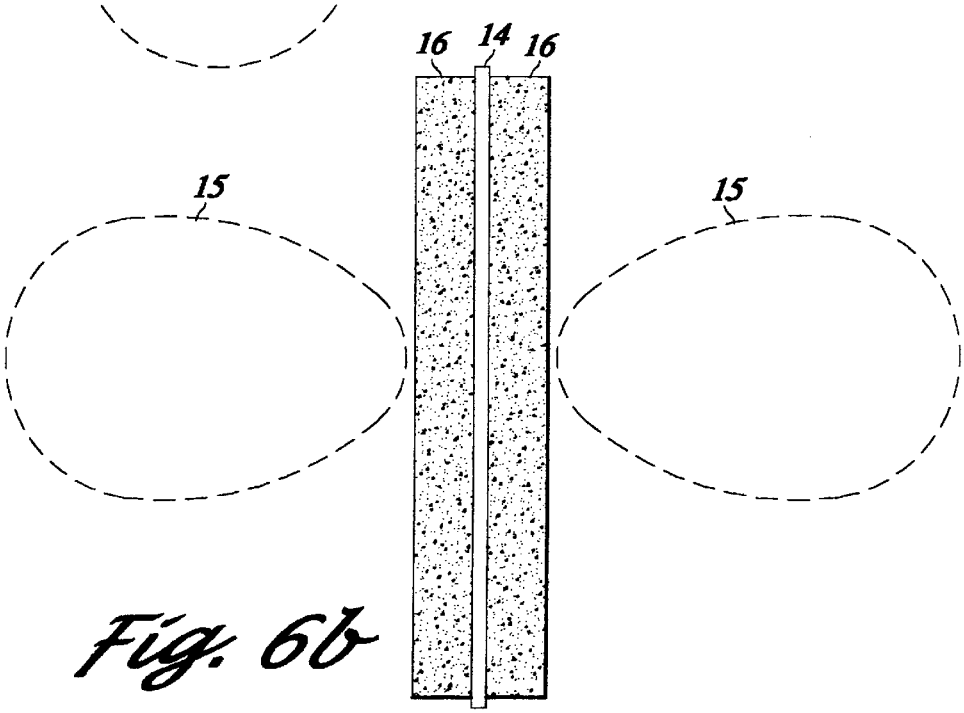

Referring now to FIGS. 6*a* and 6*b*, the beam pattern for the log-periodic bidirectional antenna assemblies are shown. As can be seen in FIGS. 6*a* and 6*b*, the beam patterns are substantially symmetric about the printed wiring board, thereby providing bidirectional transmission and reception.

Having described the structure of the bidirectional log-periodic antenna assembly of the present invention, it may be beneficial to describe the operation thereof. Consider a vertically polarized radio frequency signal having a wavelength corresponding approximately to four times the length of the longest antenna elements 44*b* attached to trunks 40*b* and 42*b*. The positive portion of such a radio frequency signal will induce current into the two longest antenna elements 44*b*. The induced current will be conducted to the feed lines via the two trunks 40*b* and 42*b*. The signal will be carried from trunk 42*b* to the center conductor 48 of the second conductor block 34*b* via micro strip conductor block 34*b* which attaches to trunk 42 as desired in detail above.

Since the two generally vertical longest antenna elements 44*b* are connected to their respective trunks 40*b* and 42*b* at opposite ends thereof, i.e., the longest antenna element 44*b* connected to trunk 42*b* is attached at the top thereof and the longest antenna element 44*b* connected to trunk 40*b* is attached at the bottom thereof, the polarity of the induced signals at the connector block 34*b* reinforce one another. Thus, the bidirectional log-periodic antenna assembly of the present invention operates according to well known principles to receive broadband radio signals.

The use of foam spacer 16, as well as generally flexible printed wiring board 14, facilitate conformance of the log periodic antenna of the present invention to a curved dielectric backing 22, the curved surface of an aircraft panel, for example. In this manner, the log-periodic antenna assembly of the present invention conforms generally to the shape of the fuselage and/or wings of an aircraft, so as to minimize aero dynamic drag thereon.

It is understood that the exemplary bidirectional log-periodic antenna assembly described herein and shown in the drawings represents only a presently preferred embodiment of the invention. Indeed, various modifications and additions may be made to such embodiment without departing from the spirit and scope of the invention. For example, the antenna assembly need not be generally circular, as described and shown. Rather, the overall shape of the antenna assembly may be any other shape, as desired. For example, the log-periodic antenna assembly may be hexagonal or octagonal. Further, those skilled in the art will appreciate that the methodology of the present invention may be utilized to extend the low frequency response of various types of antennas other than the generally circular log periodic antenna assemblies described above. For example, the methodology of the present invention may be utilized to extend the length of simple dipole antennas, Yagi antennas, etc.

Thus, these and other modifications and additions may be obvious to those skilled in the art and may be implemented to adapt the present invention for use in a variety of different applications.

What is claimed is:

1. A bidirectional broadband log-periodic antenna assembly having a comparatively small physical size, the antenna assembly comprising:

a) a printed wiring board having front and back sides;

b) a plurality of log-periodic antennas etched upon at least one side of the printed wiring board, each log-periodic antenna comprising a plurality of antenna elements extending from a common trunk, the trunk of each log-periodic antenna extending generally radially from a common point; and c) a resistive film formed upon a distal end of a longest antenna element extending from at least one trunk, the resistive film enhancing a low frequency response of the antenna assembly.

2. The bidirectional broadband log-periodic antenna assembly as recited in claim 1 wherein the antenna elements comprise portions of generally concentric circles.

3. The bidirectional broadband log-periodic antenna assembly as recited in claim 1 wherein each antenna comprises two diametrically opposed trunks, each diametrically opposed trunk having elements of substantially identical lengths extending generally perpendicularly therefrom in generally opposite directions with respect to each other diametrically opposed trunk.

4. The bidirectional broadband log-periodic antenna assembly as recited in claim 1 wherein the plurality of log-periodic antennas comprise two log-periodic antennas disposed generally radially orthogonal to one another, so as to facilitate reception and transmission of a plurality of polarizations of plane polarized electromagnetic radiation and circularly polarized electromagnetic radiation.

5. The bidirectional broadband log-periodic antenna assembly as recited in claim 1 wherein the plurality of log-periodic antennas comprise two log-periodic antennas disposed generally radially orthogonal to one another, each of the two antennas comprising two diametrically opposed trunks.

6. The bidirectional broadband log-periodic antenna assembly as recited in claim 1 further comprising a resistive film formed at a distal end of a plurality of the elements so as to increase an apparent length thereof and thus enhance a response of the elements to lower frequencies.

7. The bidirectional broadband log-periodic antenna assembly as recited in claim 1 wherein the antennas are etched upon the front side of the printed wiring board.

8. The bidirectional broadband log-periodic antenna assembly as recited in claim 1 wherein the antenna elements of adjacent antennas are not interleaved.

9. The bidirectional broadband log-periodic antenna assembly as recited in claim 1, wherein the resistive film comprises a material having a resistivity of between approximately 126 and approximately 150 ohms per square.

10. The bidirectional broadband log-periodic antenna assembly as recited in claim 1, wherein the resistive film comprises carbon.

11. The bidirectional broadband log-periodic antenna assembly as recited in claim 1, further comprising an adhesive attaching the resistive film to the antenna element(s).

12. The bidirectional broadband log-periodic antenna assembly as recited in claim 1, further comprising an adhesive film attaching the resistive film to the antenna element (s).

13. The bidirectional broadband log-periodic antenna assembly as recited in claim 1, further comprising a dielectric layer substantially covering the resistive film.

14. The bidirectional broadband log-periodic antenna assembly as recited in claim 1, wherein the resistive film has a width approximately equal to a width of the antenna element upon which it is formed.

15. The bidirectional broadband log-periodic antenna assembly as recited in claim 1, wherein the resistive film has a length approximately equal to two times a width of the element upon which it is formed.

16. A bidirectional log-periodic antenna array, the array comprising a plurality of broadband log-periodic antenna assemblies, each antenna assembly comprising:

a) a printed wiring board having front and back sides;

b) a plurality of log-periodic antennas etched upon at least one side of the printed wiring board, each log-periodic antenna comprising a plurality of antenna elements extending from a common trunk, the trunk of each log-periodic antenna extending generally radially from a common point; and c) a resistive film formed upon a distal end of a longest antenna element extending from at least one trunk, the resistive film enhancing a low frequency response of the antenna assembly.

17. A method for enhancing low frequency response of an antenna, the method comprising the steps of:

a) providing an antenna; and b) forming a resistive film upon a distal end of a longest element of the antenna.

18. The method as recited in claim 17, wherein the step of forming a resistive film upon a distal end of the antenna element comprises forming a resistive film having a resistivity of between approximately 125 and approximately 150 ohms per square.

19. The method as recited in claim 17, wherein the step of forming a resistive film upon a distal end of the antenna element comprises forming a resistive film comprised of carbon upon the antenna element.

20. The method as recited in claim 17, wherein the step of forming a resistive film upon a distal end of the longest element comprises attaching the resistive film to the element via an adhesive.

21. The method as recited in claim 17, wherein the step of forming resistive film upon the distal end of the longest element comprises attaching the resistive film to the antenna element via double-sided adhesive tape.

22. The method as recited in claim 17, further comprising the step of applying a dielectric layer over the resistive film.

23. The method as recited in claim 17, wherein the step of forming a resistive film upon an antenna element comprises forming the resistive film such that the width thereof is approximately equal to the width of the antenna element upon which it is formed.

24. The method as recited in claim 17, wherein the step of forming a resistive film upon an antenna element comprises forming the resistive film has a length approximately equal to two times a width of the element upon which it is formed.

25. An antenna having an enhanced low frequency response, the antenna comprising:

a) at least one antenna element; and, b) a resistive film formed upon a distal end of a longest antenna element of the antenna, the resistive film enhancing a low frequency response thereof.

* * * * *